US006241122B1

(12) United States Patent
Araki et al.

(10) Patent No.: US 6,241,122 B1
(45) Date of Patent: Jun. 5, 2001

(54) PLUG AND AMORPHOUS CONTAINER USING THE PLUG

(75) Inventors: Yozo Araki; Akira Ikemori, both of Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/355,613

(22) PCT Filed: Dec. 16, 1998

(86) PCT No.: PCT/JP98/05669

§ 371 Date: Jul. 30, 1999

§ 102(e) Date: Jul. 30, 1999

(87) PCT Pub. No.: WO99/33712

PCT Pub. Date: Jul. 8, 1999

(30) Foreign Application Priority Data

Dec. 26, 1997 (JP) ..... 9-359136

(51) Int. Cl.[7] ..... B65D 35/24
(52) U.S. Cl. ..... 222/92; 222/107; 222/464.2
(58) Field of Search ..... 222/92, 105, 107, 222/464.1, 464.2, 541.2

(56) References Cited

U.S. PATENT DOCUMENTS

| | | | | |
|---|---|---|---|---|
| 3,420,413 | * | 1/1969 | Corsette | 222/107 |
| 4,286,636 | * | 9/1981 | Credle | 222/501 |
| 4,445,539 | * | 5/1984 | Credle | 137/614.03 |
| 4,718,778 | | 1/1988 | Ichikawa . | |
| 4,783,176 | * | 11/1988 | Ichikawa | 383/80 |
| 5,169,037 | * | 12/1992 | Davies et al. | 222/402.1 X |
| 5,289,952 | * | 3/1994 | Gueret | 222/190 |
| 5,370,272 | * | 12/1994 | Gueret | 222/95 |
| 5,465,872 | * | 11/1995 | Gueret | 222/95 |
| 5,711,454 | * | 1/1998 | Kobayashi et al. | 222/95 |
| 5,746,350 | * | 5/1998 | Nishigami et al. | 222/95 |

FOREIGN PATENT DOCUMENTS

| | | |
|---|---|---|
| 60-68255 | 4/1985 | (JP) . |
| 61-137539 U | 8/1986 | (JP) . |
| 63-34070 U | 3/1988 | (JP) . |
| 63-76653 U | 5/1988 | (JP) . |
| Y2 221399 | 6/1990 | (JP) . |
| 326751 U | 3/1991 | (JP) . |
| 814883 | 7/1991 | (JP) . |
| 526845 U | 4/1993 | (JP) . |
| Y2544294 | 11/1993 | (JP) . |
| Y2 718595 | 5/1995 | (JP) . |
| 3038175 U | 3/1997 | (JP) . |
| 9142497 | 6/1997 | (JP) . |
| 9193946 | 7/1997 | (JP) . |

* cited by examiner

*Primary Examiner*—Kenneth Bomberg

(57) ABSTRACT

A cylindrical plug (10) attached to a pouchy container proper capable of varying shape as passed through the container proper (1) in such a manner that one terminal side thereof is positioned inside the container proper (1) and the other terminal side thereof positioned outside the container proper (1). This plug comprises a split pipe (18) joined to one terminal side of the plug and divided into two halves along the longitudinal direction thereof so as to be provided with interstices (19) intercommunicating between the inside and the outside and a joint plate (17) for integrally coupling one and the other half of the split pipe. It, therefore, secures a path for air or liquid during the aspiration of the liquid from the interior of the container proper (1). When the container proper (1) happens to develop negative pressure, the plug prevents the path for the liquid from being blocked owing to the flexibility of the container proper (1), precludes the occurrence of a dead space for stagnating liquid in the upper part of the container proper (1), and enables the split pipe (18) to retain the shape and the strength thereof.

17 Claims, 20 Drawing Sheets

PLUG AND AMORPHOUS CONTAINER USING THE PLUG this application is the national phase under 35 U.S.C. §371 of PCT International Application No. PCT/JP98/05669 which has an International filing date of Dec. 16, 1998 which designated the United States of America.

TECHNICAL FIELD

This invention relates to a plug and a container of indeterminate shape utilizing the plug.

BACKGROUND ART

Pouch containers of indeterminate shape which are capable of varying shape (hereinafter referred to as "pouches") have been increasingly utilized in various fields in recent years because they can be stored conveniently and discarded easily after use. The pouches of this type have a plug fitted with a screw type cap for the purpose of facilitating the entry therein and the exit therefrom of a liquid and allowing the preservation therein of a remaining part of the liquid. This plug is in the shape of a long cylinder having one terminal side thereof inserted into the interior of the pouch and the other terminal side thereof projected out of the pouch for the purpose of preventing the pouch from being folded and securing a flow path for the liquid. Since these pouches are prone to vary volume, they are charged with a liquid by means of a metering packing machine.

Plugs intended for use in the pouches of this type have been proposed in various patent publications. For example, a plug using a pipe provided as extended into a pouch and provided at the leading end thereof and at the fitting part thereof with openings was proposed in Japanese Utility Model publication (examined) Hei. 2-21399, a plug using a pipe disposed as extended into a pouch and provided in the pipe with a plurality of througholes was proposed in Japanese Utility Model publication (examined) Hei. 5-44294 , and a plug using a pipe disposed as extended into a pouch and splitting this pipe thereby forming interstices in the pipe was proposed in Design Registration No. 814883.

The plugs which are used for the pouches described above are required to fulfill various conditions such as allowing easy extraction of the air entrapped in the pouch before the pouch is filled with the liquid, allowing easy extraction of the liquid from the pouch without leaving behind a residue thereof in the pouch, and not allowing the plug to slant when the pouch is filled with the liquid (with a view to enhancing ease of handling and improving appearance). Despite this fact, the plugs which have been proposed in the patent publications mentioned above they encounter difficulty in wholly satisfying such various conditions as mentioned above.

Specifically, the plug proposed in Japanese Utility Model publication (examined) Hei. 2-21399 is incapable of thoroughly extruding the liquid stagnating in the periphery of the middle part of the pipe because of the length of the pipe extending into the pouch, and the plug proposed in Japanese Utility Model publication (examined) Hei. 5-44294 not only suffers incapability of attaining thorough extrusion of the liquid stagnating around the pipe and in the plurality of through holes but also incurs high cost because of the complexity of shape. Further, since these plugs both occupy large volumes relative to the inner volumes of their respective pouches, they cause considerable amounts of liquid to persist therein and compel their pouches to suffer from poor efficiency of liquid retention. The plug proposed in Design Registration No. 814,883 exhibits only inferior strength and possibly deforms while the pouch is being charged with a liquid heated to an elevated temperature. Further, when these plugs are randomly piled up and handled by means of an automatic aligning device, they have the possibility of inconveniencing the aligning operation by suffering the leading ends of some of the pipes of the plugs to be nipped between the openings in the other pipes.

DISCLOSURE OF THE INVENTION solve the problem mentioned above, the plug according to the present invention is a cylindrical plug which is attached to a pouchy container proper which is capable of varying shape, and is passed through the container proper in such a manner that one terminal side thereof may be positioned inside the container proper and the other terminal side thereof positioned outside the container proper, and it comprises by comprising a split pipe connected to the one terminal side thereof and divided into two halves along the longitudinal direction thereof so as to be provided with interstices intercommunicating between the inside and the outside thereof and a joint plate for integrally coupling one and the other half of the split pipe. By this construction, the plug is capable of enhancing the strength of the split pipe, preventing the split pipe from being deformed even when it handles a charging liquid heated to an elevated temperature, enabling the length of its own on the inner side of the container proper to be restricted to the minimum size necessary for preventing the container proper from being folded, improving the volume efficiency of the container proper, eliminating the waste of the liquid, and decreasing the cost of material in addition to fulfilling such conditions as allowing extraction of the entrapped air while the container is charged with the liquid, enabling the liquid in the container proper to be aspirated without leaving behind a residue thereof in the container proper, precluding the persistence of the liquid in the container proper while the liquid is being transferred to another container, and preventing itself from slanting inside the container proper when the container is filled with the liquid (for the purpose of enhancing ease of handling and improving appearance).

In the plug mentioned above, the section in the direction of diameter of the split pipe coupled by the joint plate is preferably formed as generally S-shaped, and the positions of the interstices of the split pipe and the direction of the joint coincide with the direction of drawing the other terminal side from the molding die. These conditions result in simplifying the structure of the molding die and lowering the initial cost.

In the plug mentioned above, the section in the direction of diameter of the split pipe coupled by the joint plate is preferably formed as generally Z-shaped, and the inner wall of the split pipe forms a flat surface coinciding with the direction of drawing the other terminal side from the molding die. These conditions facilitate the work of drawing the pipe from the molding die.

In the plug mentioned above, the split pipe is preferably provided on the outer surface thereof with reinforcing ribs. The reinforcing ribs can prevent the split pipe from being deformed when the plug is handling a charging liquid heated to an elevated temperature because they are capable of enhancing the strength of the split pipe.

In the plug mentioned above, the split pipe is preferably provided at the leading end thereof with a base plate. Since the base plate is capable of preventing the split pipe from being caught on the container proper or on other plugs, the possibility of the container proper sustaining injury can be precluded and, even when a multiplicity of such split pipes are randomly piped up by an automatic aligning device, the possibility of these split piles inflicting damage on one another can be avoided.

In the plug mentioned above, the split pipe is provided at the leading end thereof with a chamfer. Since the chamfer is capable of preventing the split pipe from being caught on the container proper or on other plugs, the possibility of the container proper sustaining injury can be precluded and, even when a multiplicity of such split pipes are randomly piped up by an automatic aligning device, the possibility of these split piles inflicting damage on one another can be avoided.

In the plug mentioned above, the joint plate is preferably laid throughout the entire length of the split pipe. This arrangement can further enhance the strength of the split pipe.

In the plug mentioned above, the joint plate is preferably laid across the interval between the leading terminal and the proximity of the basal terminal of the split pipe in such a manner that a through hole of a size smaller than the diameter on the leading terminal side of the split pipe is formed on the basal terminal side of the split pipe. This through hole enables the interior of the split pipe to form a continuous path in the direction of diameter while allowing the split pipe to keep the strength thereof intact and, at the same time, prevents the split pipe from being intruded by the leading end of other plug. Even when a multiplicity of such plugs are randomly piled up by the automatic aligning device, they can be smoothly handled without being caught on one another.

In the plug mentioned above, protuberances as the gates for guiding the molten resin during the course of molding are preferably disposed in the connecting part between the split pipe and the joint plate. These gates improve the run of the molten resin at the time injection, preclude the trouble of short shots, and enhance the yield. In this case, a device for cutting off the gate resin by constricting the neighborhood of the outlet of the gate enables a gate mark to remain on the inner side of the split pipe and consequently obviates the necessity for such additional treatments as the removal of the residual resin protruding from the gate.

The pouchy container of indeterminate shape according to this invention is characterized by the plug being attached to the container proper capable of varying shape as passed therethrough in such a manner that one terminal side of the plug is positioned inside the container proper and the other terminal side of the plug is positioned outside the container proper. By this construction, the container is capable of attaining the effects which are attained by the plug mentioned above.

In the container of indeterminate shape mentioned above, an inner lid formed of film is preferably watertightly fastened thermally to the other terminal of the plug mentioned above. This inner lid can perfectly seal the interior of the container tightly. As a result, the container can be applied to a neutral liquid because the container charged with the liquid can be immersed in hot water for the purpose of thermally sterilizing the liquid held therein.

The container of indeterminate shape mentioned above is preferably provided with a cap which comprises a cylindrical main body having one terminal side thereof screwed removably to the other terminal of the plug, an inner plate disposed in the central part of the interior of the main body mentioned above and adapted to partition the interior of the main body into one terminal side and the other terminal side, and a protuberance raised from the inner plate on the other terminal side of the main body. By this construction, by turning the cap till it is removed from the plug and then depressing the cap so as to insert the other terminal side of the cap into the mouth part of the plug, the inner lid can be easily broken through by the protuberance of the cap and the liquid in the container can be easily taken out through the plug.

PREFERRED EMBODIMENTS

FIRST EMBODIMENT

The first embodiment of the plug according to this invention and the container of indeterminate shape utilizing the plug (hereinafter referred to as "pouch") will be described by reference to FIGS. 1 –6.

Figure 1:
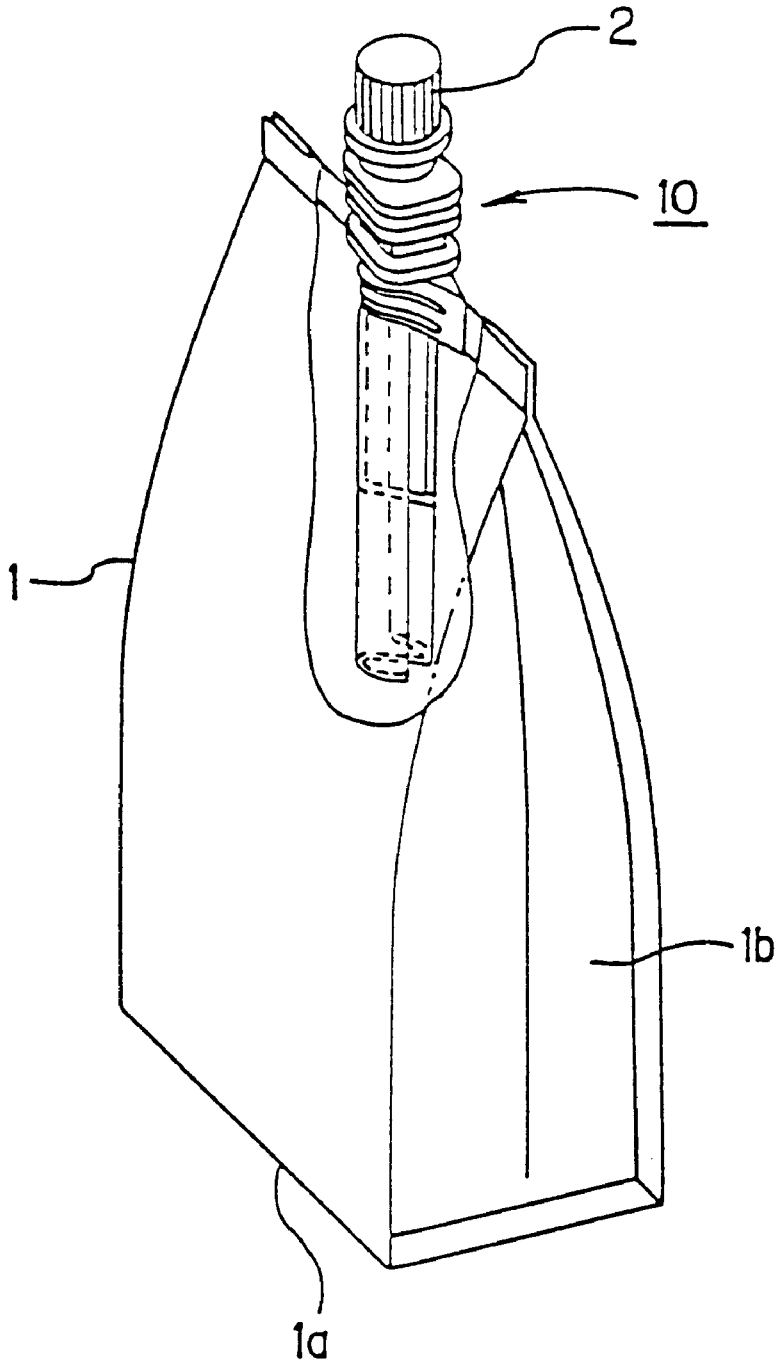
FIG. 1 is a perspective view illustrating the entire structure of the first embodiment of the container of indeterminate shape according to this invention.
Figure 2:
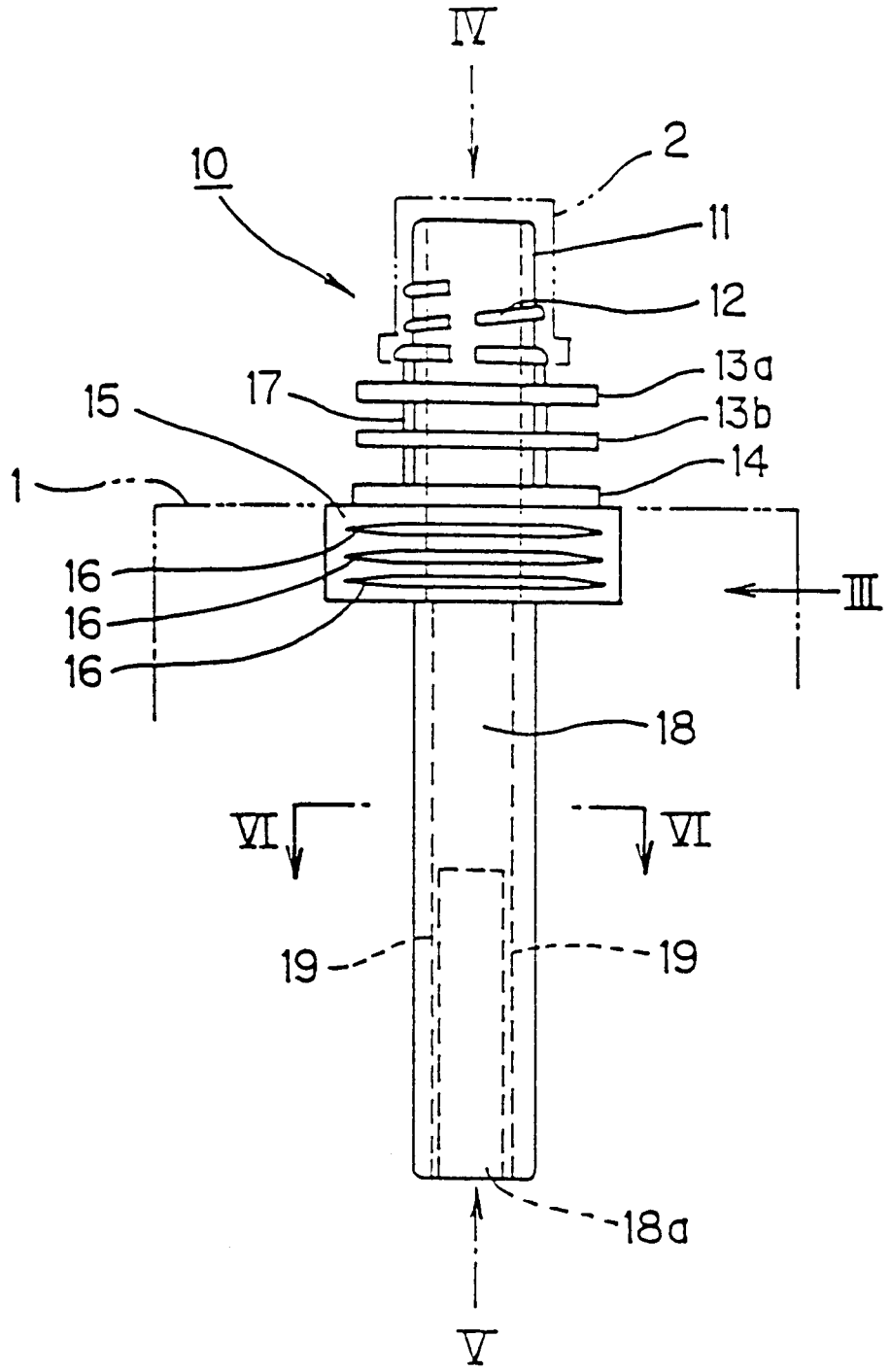
FIG. 2 is a front view of the plug shown in FIG. 1.
Figure 3:
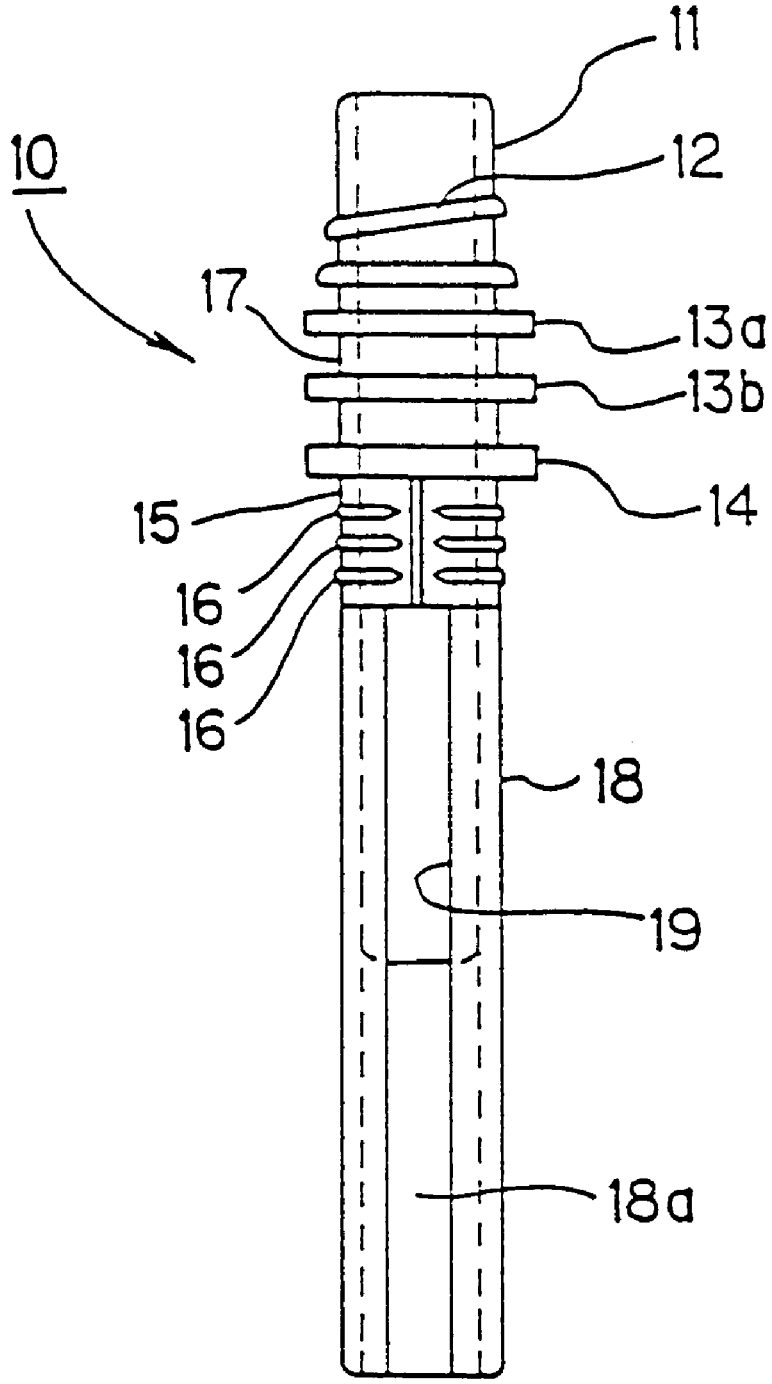
FIG. 3 is a side view of FIG. 2 taken from the direction of an arrow mark III.
Figure 4:
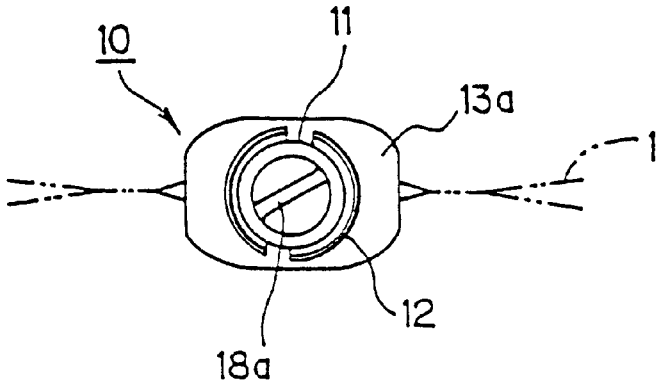
FIG. 4 is a plan view of FIG. 2 taken from the direction of an arrow line IV.
Figure 5:
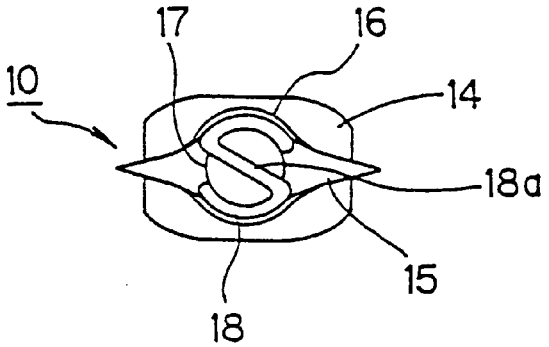
FIG. 5 is a bottom view of FIG. 2 taken from the direction of an arrow line V.
Figure 6:
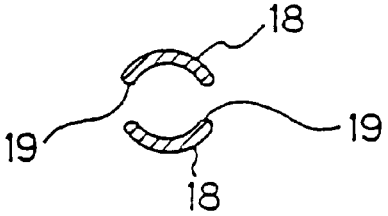
FIG. 6 is a cross section taken through FIG. 2 along the line VI—VI.

A container proper 1 which is formed of a laminate film produced by superposing a heat-sealing quality film, a resin film possessing high tensile strength, an aluminum foil, a resin film of fine printability, and the like sequentially from the inner side upward and uniting them is manufactured by thermal adhesion into a pouch capable of varying shape, with one gusset 1*a* and two gussets 1*b* formed respectively on the bottom part and the opposite lateral parts of the pouch proper, as illustrated in FIG. 1. A cylindrical plug 10 having one terminal side thereof positioned inside the container proper 1 and the other terminal side thereof positioned outside the container proper 1 is attached to the upper part of the container proper 1 as passed through the container proper 1. The plug 10 is integrally formed as by an injection molding device and is constructed as follows.

As illustrated in FIGS. 2–5, an adhesive part 15 shaped like a boat having the longitudinal direction thereof oriented in the direction of width of the container proper 1 is formed on the outer surface of the basal terminal side (one terminal side) inserted into the container proper 1 of a pipe 17 destined to serve as a liquid path intercommunicating the inside and the outside of the container proper 1. A plurality of ridges 16 are formed on the lateral surface of the adhesive part 15. The ridges 16 are so adapted as to be easily fastened to the container proper 1 in a water tight manner.

The leading terminal (the other terminal) of the pipe 17 protruding from the container proper 1 forms a smoothly finished mouth part 11. On the outer surface of the pipe 17 below the mouth part 11, a screw 12 adapted to be meshed with a cap 2 is formed. Below the screw 12, two parallel flanges 13*a*, 13*b* for enabling the plug to be suspended for the sake of handling are formed. Below the flanges 13*a*, 13*b* mentioned above, a flange 14 adapted to fix the position of the plug by colliding against the upper edge of the container proper 1 is formed.

Below the adhesive part 15 mentioned above, a split pipe 18 split into two halves along the longitudinal direction is integrally formed at the opposite positions in the direction of width of the container proper 1 in such a manner as to be provided with two interstices 19 intercommunicating the inner side and the outer side. The interstices 19 are such that they serve as a path for air or liquid while the liquid in the container proper 1 is being aspirated and they prevent the path for liquid from being blocked by the flexibility of the container proper 1 and preclude the occurrence of a dead space for residual liquid in the upper part of the container proper 1. In the proximity of the leading terminal (lower terminal) of the split pipe 18, a joint plate 18*a* for joining the divided halves of the spilt pipe 18 in the direction of width of the container proper 1 is formed so that the section thereof in the direction of diameter is formed as generally S-shaped. The joint plate 18*a* is adapted to retain the shape of the split pipe 18 and preserve the strength thereof.

In the pouch utilizing the plug 10 of this construction, since the split pipe 18 furnished with the interstices 19 is connected to the part of the container proper 1 through which the pipe 17 is inserted into the container proper, the container proper 1 can be infallibly evacuated without giving rise to a dead space in the upper part of the container proper 1 by vacuumizing the interior of the container proper 1 through the mouth part 11 of the plug 10. By charging the container proper 1 with a liquid through the mouth part 11 after the vacuumization mentioned above, therefore, the liquid is enabled to fill the interior of the container proper 1 as far as the vicinity of the base of the pipe 17.

When the liquid in the container proper 1 is aspirated through the mouth part 11 of the plug 10, the aspiration can be effected infallibly and easily without leaving behind a residue of the liquid inside the container proper 1 because the liquid is aspirated through the leading terminal and the interstices 19 of the split pipe 18 inside the container proper 1 and also because the periphery of the split pipe 18 of the container proper 1 is deformed and the inner volume of the container proper 1 is decreased. Further, by crushing the upper part of the container proper 1, the liquid can be easily transferred into another container without leaving behind a residue of the liquid in the interior of the container proper 1.

By the formation of the joint plate 18*a* on the split pipe 18 and the consequent exaltation of the strength of the split pipe 18, the volume efficiency of the container proper 1 can be heightened and the amount of the liquid suffered to remain inside the container proper 1 during the aspiration of the liquid can be decreased to a great extent because the split pipe 18 is not easily deformed while the pouch is being filled with a liquid heated to an elevated temperature and further because the length of the plug 10 on the inner side of the container proper 1 is limited to the minimum size necessary for preventing the container proper 1 from being folded. The plug 10 is not sloped even when the container proper 1 is filled with the liquid to capacity. The effects enumerated above can be attained at a low cost.

SECOND EMBODIMENT

The second embodiment of the plug according to this invention and the pouch utilizing this plug will be described by reference to FIGS. 7–12. It is provided, however, that the parts like those of the first embodiment described above will be denoted by the reference numerals like those used in the description of the first embodiment and these parts will be omitted from the following description.

Figure 7:
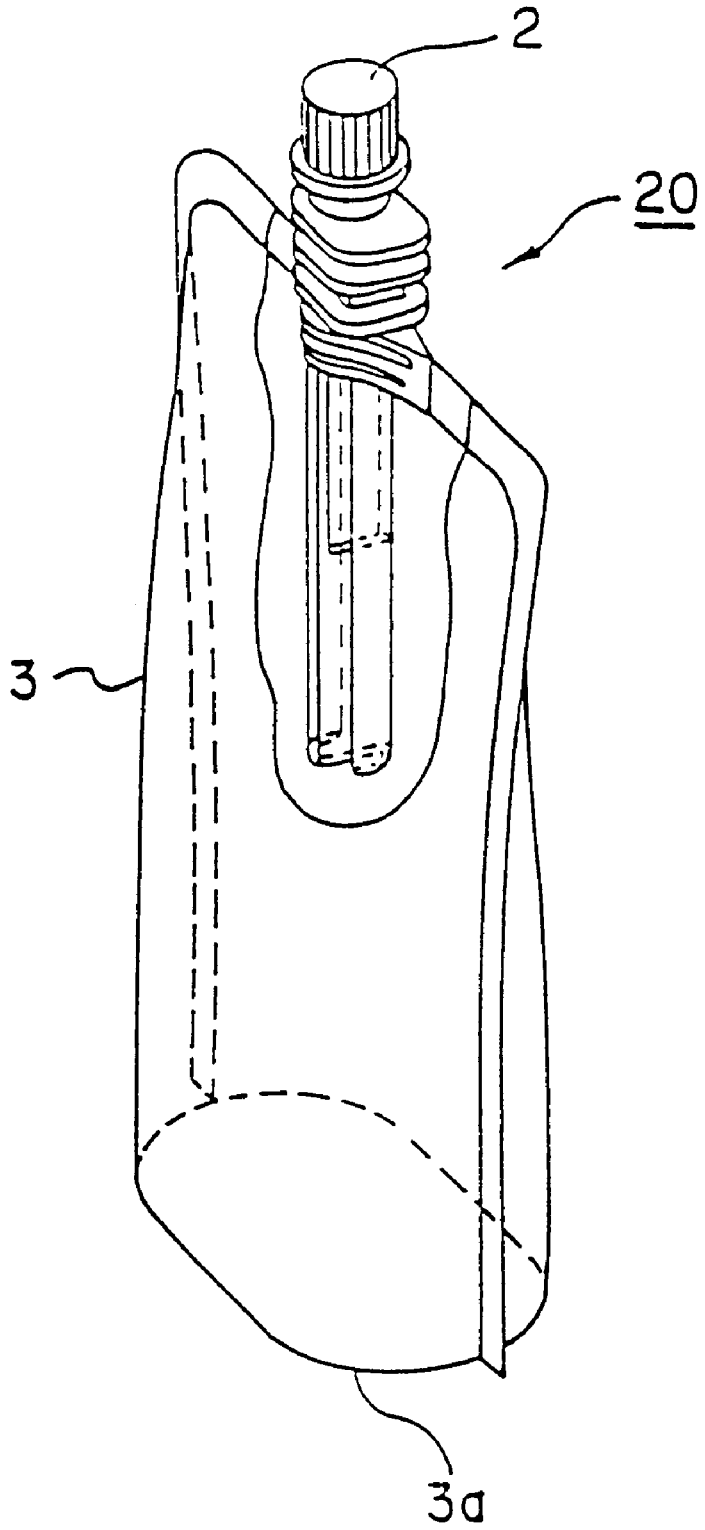
FIG. 7 is a perspective view illustrating the entire structure of the second embodiment of the container of indeterminate shape according to this invention.
Figure 8:
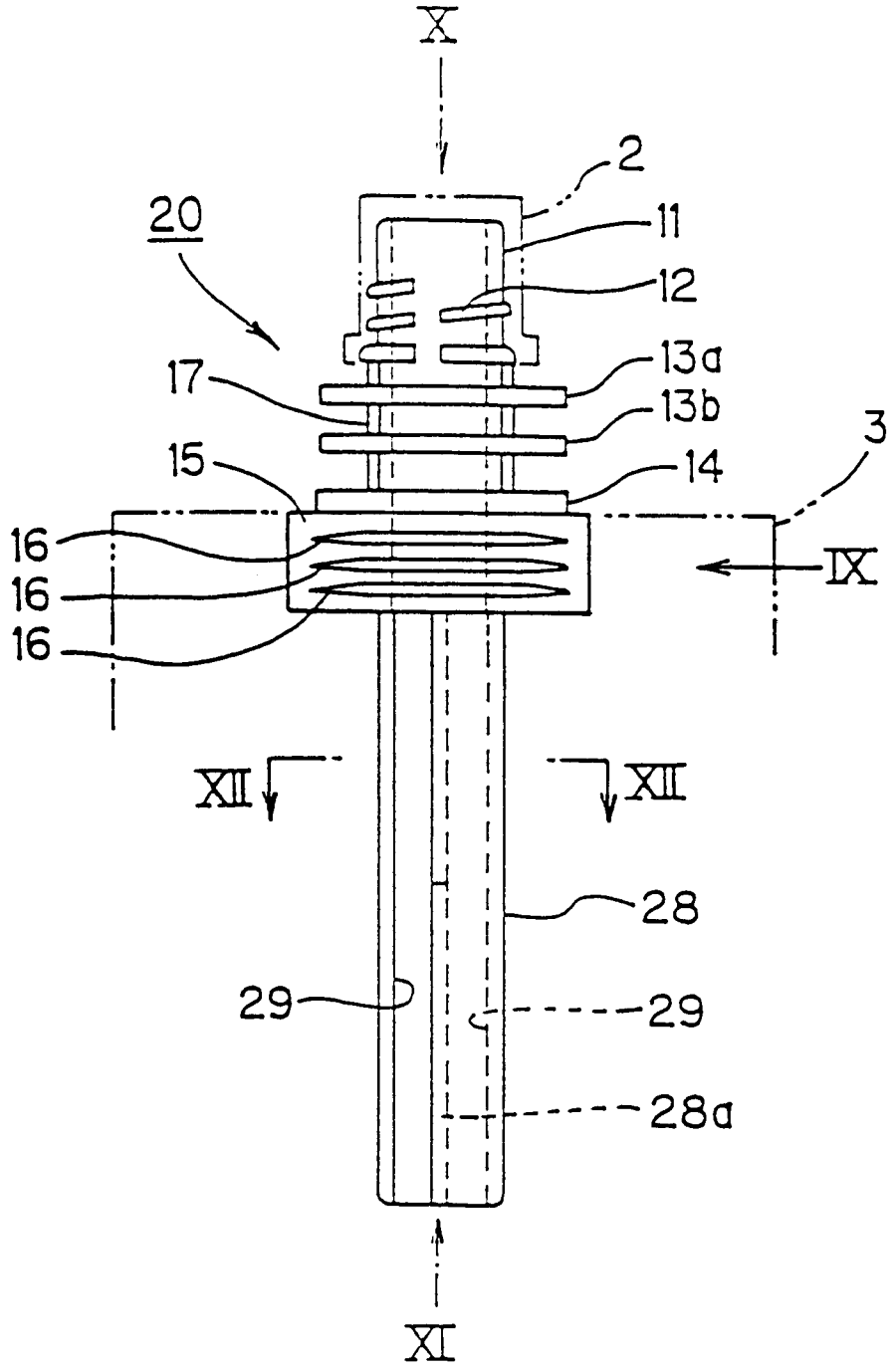
FIG. 8 is a front view of the plug shown in FIG. 7.
Figure 9:
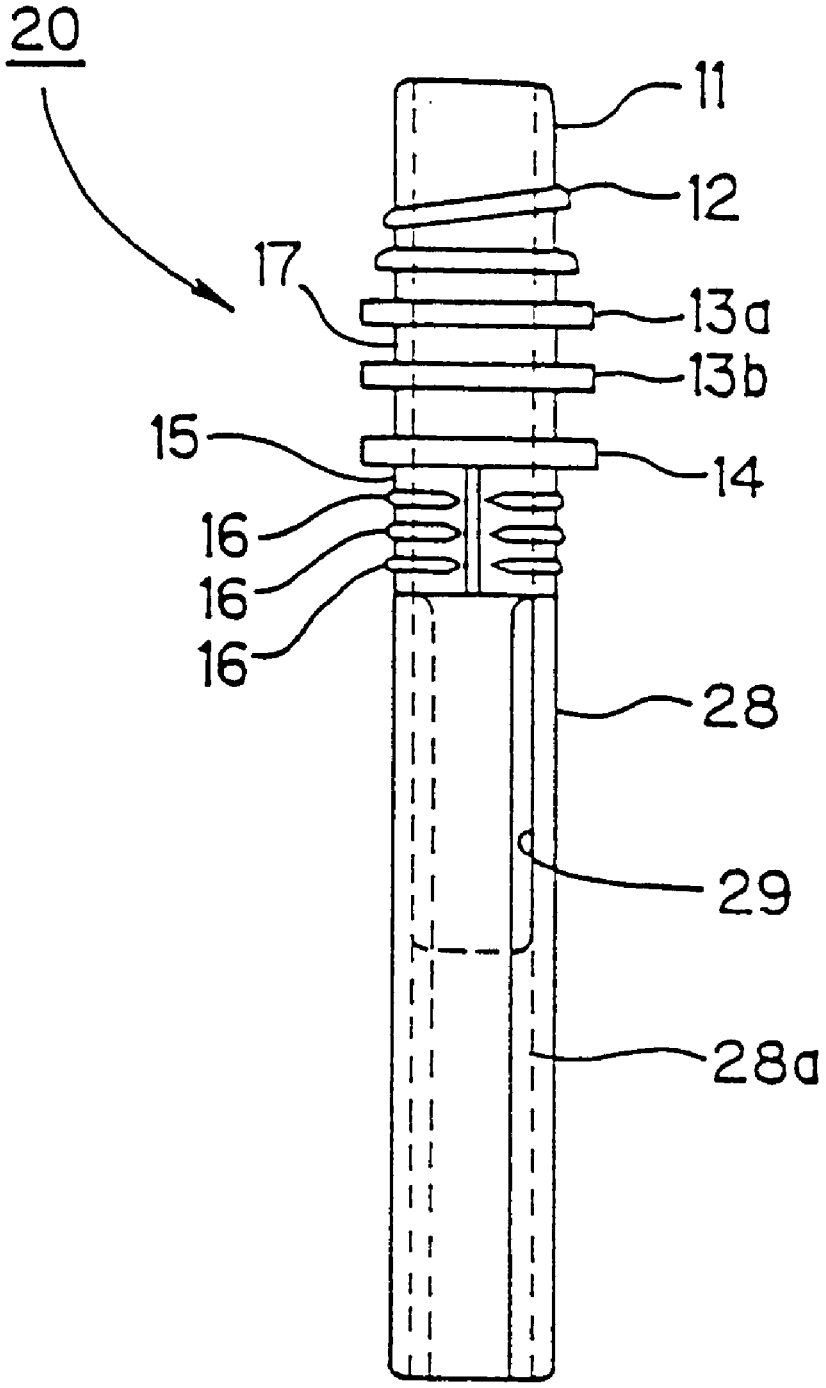
FIG. 9 is a side view of FIG. 8 taken from the direction of an arrow mark IX.
Figure 10:
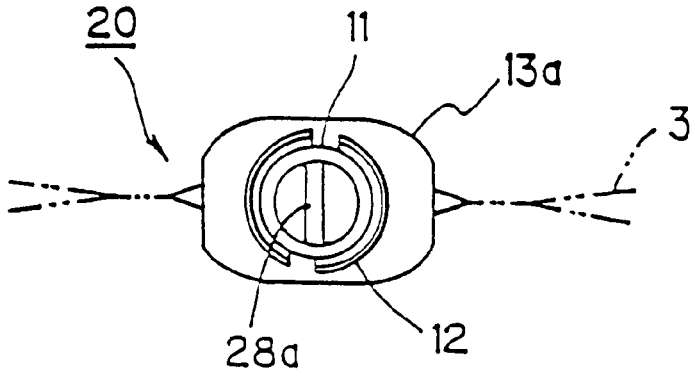
FIG. 10 is a plan view of FIG. 8 taken from the direction of an arrow line X.
Figure 11:
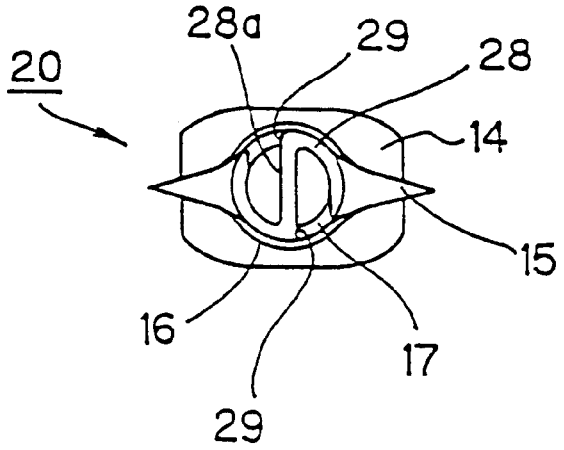
FIG. 11 is a bottom view of FIG. 8 taken from the direction of an arrow line VI.
Figure 12:
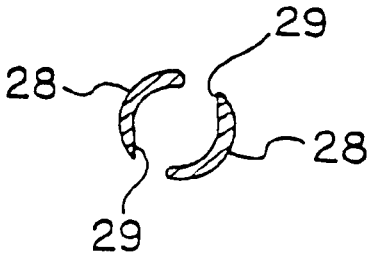
FIG. 12 is a cross section taken through FIG. 8 along the line XII—XII.
Figure 13:
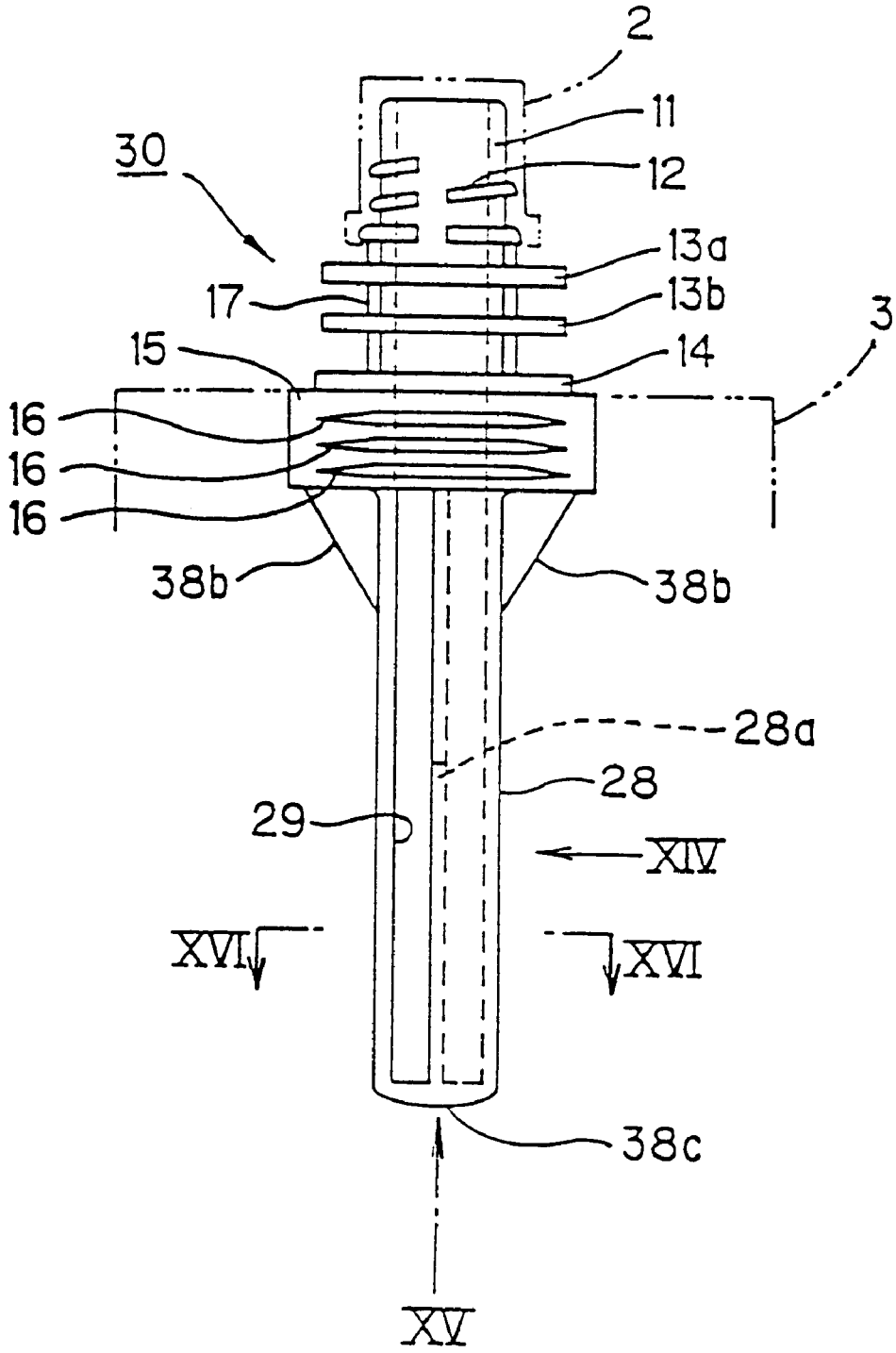
FIG. 13 is a front view of the third embodiment of the plug according to this invention.
Figure 14:
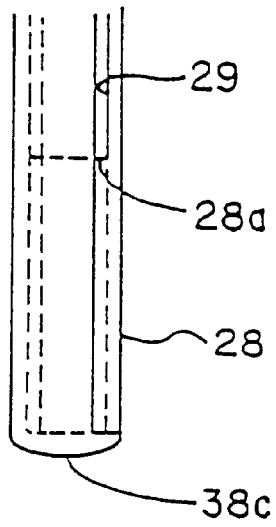
FIG. 14 is a partly extracted side view of FIG. 13 taken from the direction of an arrow mark XIV.
Figure 15:
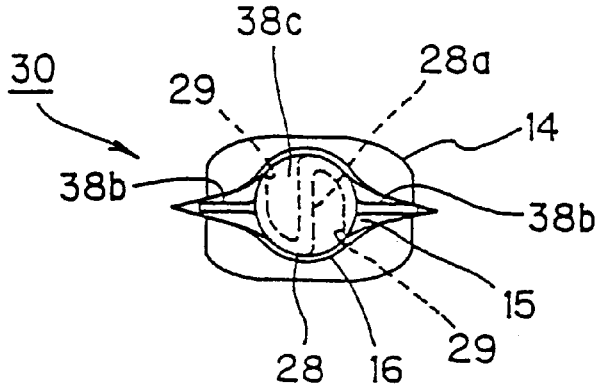
FIG. 15 is a bottom view of FIG. 13 taken from the direction of an arrow line XV.
Figure 16:
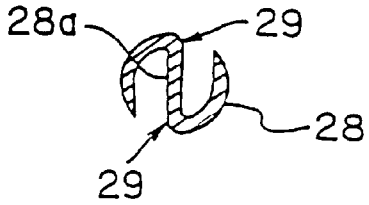
FIG. 16 is a cross section taken through FIG. 13 along the line XVI—XVI.

A container proper 3 which is formed of a laminate film produced by superposing a heat-sealing quality film, a resin film possessing high tensile strength, an aluminum foil, a resin film of fine printability, and the like sequentially from the inner side upward and uniting them is manufactured by thermal adhesion into a pouch capable of varying shape, with one gusset 3*a* formed on the bottom part of the pouch proper, as illustrated in FIG. 7. The container proper 3 in this embodiment has the gusset 3*a* formed only on the bottom part.

Below the adhesion part 15 of a plug 20, a split pipe 28 divided into two halves along the longitudinal direction at the opposite positions (the opposite positions in the direction of a minor side of the adhesion part 15) in the direction of thickness of the container proper 3 is integrally formed so as to be provided with two interstices 29 intercommunicating the inside and the outside as illustrated in FIGS. 8–12. In the proximity of the leading terminal of the split pipe 28, a joint plate 28*a* adapted to join the divided halves of the split pipe 28 in the direction of thickness of the container proper 1 is so formed that the section thereof in the direction of diameter assumes the general shape of the letter S.

In short, while the first embodiment described above uses the split pipe 18 provided at the opposite positions in the direction of width of the container proper 1 (the positions in the longitudinal direction of the adhesion part 15) with the interstices 19 and joined with the joint plate 18*a*, the present embodiment uses the split pipe 28 provided at the opposite positions (the opposite positions in the direction of a minor side of the adhesion part 15) with the interstices 29 and joined with the joint plate 28*a* in the direction of thickness of the container proper 1 (the direction of the minor side of the adhesion part 15).

The plug 20 in the present embodiment, therefore, enables the construction of the molding die therefor to be simplified as compared with that in the first embodiment described above because the split pipe 28 part of the molding die coincides with the direction of drawing the other terminal side (the part of the adhesion part 15 and the like).

The present embodiment, therefore, not only acquires the same effects as the first embodiment described above but also permits the initial cost to be smaller than the first embodiment described above.

While this embodiment, as described above, uses the container proper 3 having the gusset 3*a* formed solely on the bottom part thereof, it optionally allows use of the container proper 1 which has the gussets 1*a*, 1*b* formed on the bottom part and the lateral sides.

THIRD EMBODIMENT

The third embodiment of the plug according to this invention and the pouch utilizing the plug will be described below by reference to FIGS. 13–16. It is provided, however, that the parts like those of the first and second embodiments described above will be denoted by the reference numerals like those used in the description of the first and second embodiments and these parts will be omitted from the following description.

A pair of reinforcing ribs 38*b* are integrally formed between the lower part of the adhesion part 15 and the outer surface of the split pipe 28 as illustrated in FIGS. 13–16. At the leading terminal of the split 28, a bottom plate 38*c* for closing the leading terminal mentioned above is integrally formed. The bottom plate 38*c* is adapted to prevent the leading terminal of the split pipe 28 from inflicting an injury on the container proper 3 when a plug 30 is enabled to retain its posture by the collision of the split pipe 28 against the container proper 1.

That is, the plug 30 in the present embodiment is identical in construction with the plug 20 in the second embodiment described above excepting that it is provided additionally with the reinforcing ribs 38*b* and the bottom plate 38*c*.

The present embodiment, therefore, not only attains the same effects as those of the second embodiment described above but also allows the strength of the split pipe 28 to be further greater than that of the split pipe 28 in the second embodiment described above. As respects the possibility that, during the course of cutting off the leading terminal of the split pipe 28, the corners of the leading terminal of the split pipe 28 will rub against the container proper 1 and the container proper 1 will be nipped in the interstices 29 of the split pipe 28 and consequently caused to sustain a scratch, the damage inflicted on the container proper 1 of the present embodiment can be repressed to a general extent because the split pipe 28 is provided at the leading terminal thereof with the bottom plate 38*c* having rounded corners.

While this embodiment, as described above, uses the container proper 3 having the gusset 3*a* formed solely on the bottom part thereof, it optionally allows use of the container proper 1 which has the gussets 1*a*, 1*b* formed on the bottom part and the lateral sides.

FOURTH EMBODIMENT

The fourth embodiment of the plug according to this invention and the pouch utilizing the plug will be described below by reference to FIGS. 17–19. It is provided, however, that the parts like those of the first through third embodiments described above will be denoted by the reference numerals like those used in the description of the first through third embodiments and these parts will be omitted from the following description.

Figure 17:
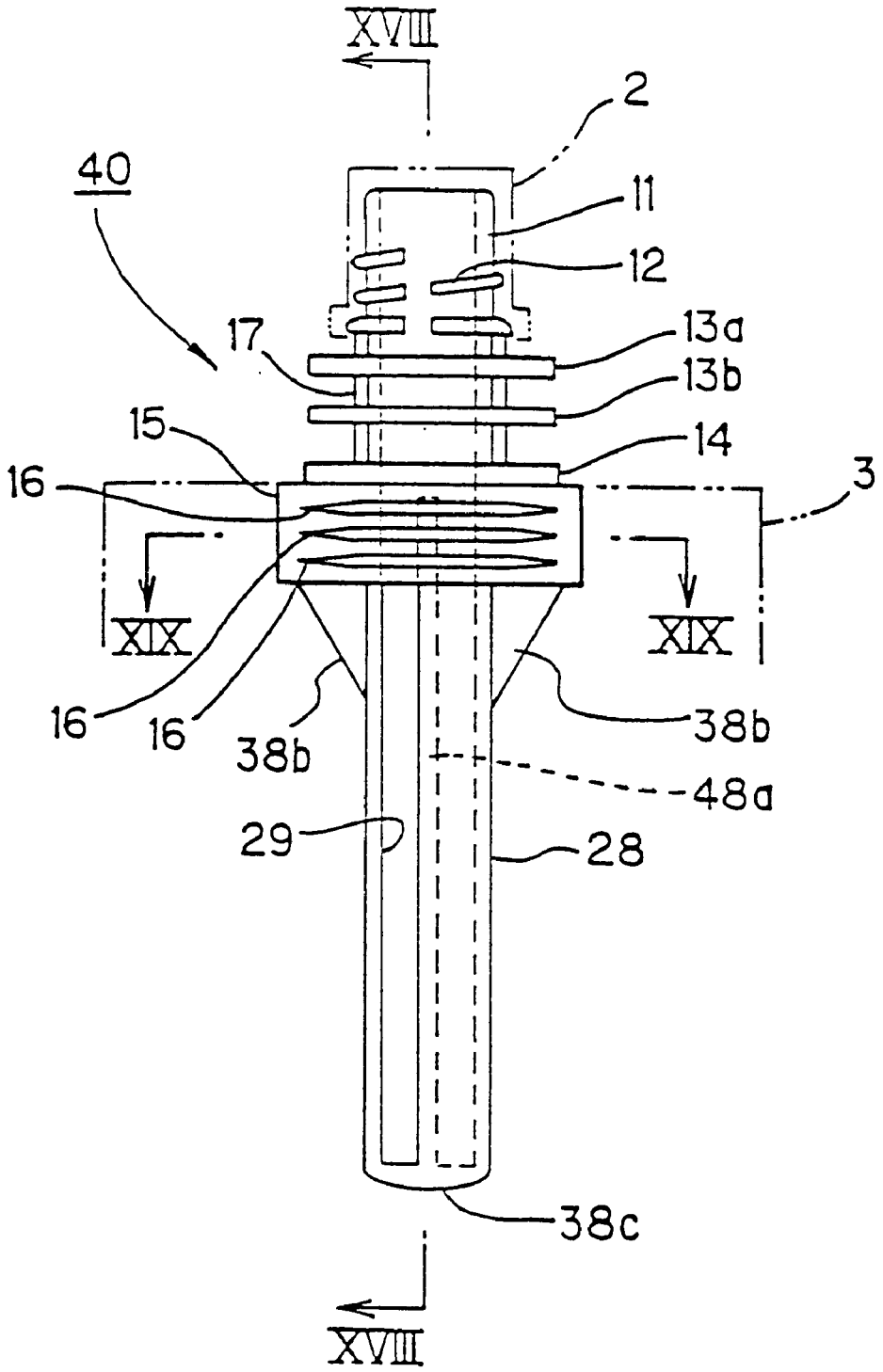
FIG. 17 is a front view of the fourth embodiment of the plug according to this invention.
Figure 18:
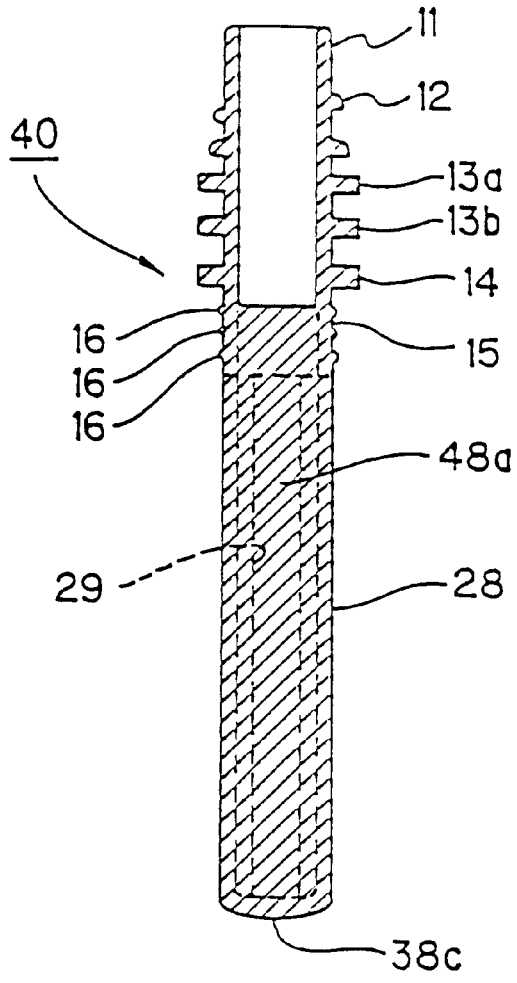
FIG. 18 is a cross section taken through FIG. 17 along the line XVIII—XVIII.
Figure 19:
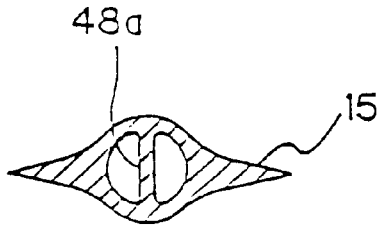
FIG. 19 is a cross section taken through FIG. 17 along the line XI—XIX.

In the split pipe 28, a joint plate 48*a* is disposed throughout the entire length of the split pipe 28 as illustrated in FIGS. 17–19.

That is, a plug 40 in the present embodiment has a construction using the joint plate 48*a* in the place of the joint plate 28*a* of the plug in the third embodiment mentioned above, i.e. a construction having the joint plate 28*a* in the third embodiment extended to the basal terminal side of the split pipe 28.

The present embodiment, therefore, not only attains the same effects as those of the third embodiment described above but also allows the strength of the split pipe 28 to be further greater than that of the split pipe 28 in the third embodiment described above.

While this embodiment, as described above, uses the container proper 3 having the gusset 3*a* formed solely on the bottom part thereof, it optionally allows use of the container proper 1 which has the gussets 1*a*, 1*b* formed on the bottom part and the lateral sides.

FIFTH EMBODIMENT

The fifth embodiment of the plug according to this invention and the pouch utilizing the plug will be described below by reference to FIGS. 20–24. It is provided, however, that the parts like those of the first through fourth embodiments described above will be denoted by the reference numerals like those used in the description of the first through fourth embodiments and these parts will be omitted from the following description.

Below the adhesion part 15 of a plug 50, a split pipe 58 forming a flat smooth inner wall is integrally formed as illustrated in FIGS. 20–24.

That is, the split pipe 58 in the present embodiment resembles the split pipe 18 in the first embodiment described above excepting the inner wall is formed in a flat surface, i.e. the section of the split pipe 58 in the direction of diameter assumes the general shape of the letter Z.

Figure 20:
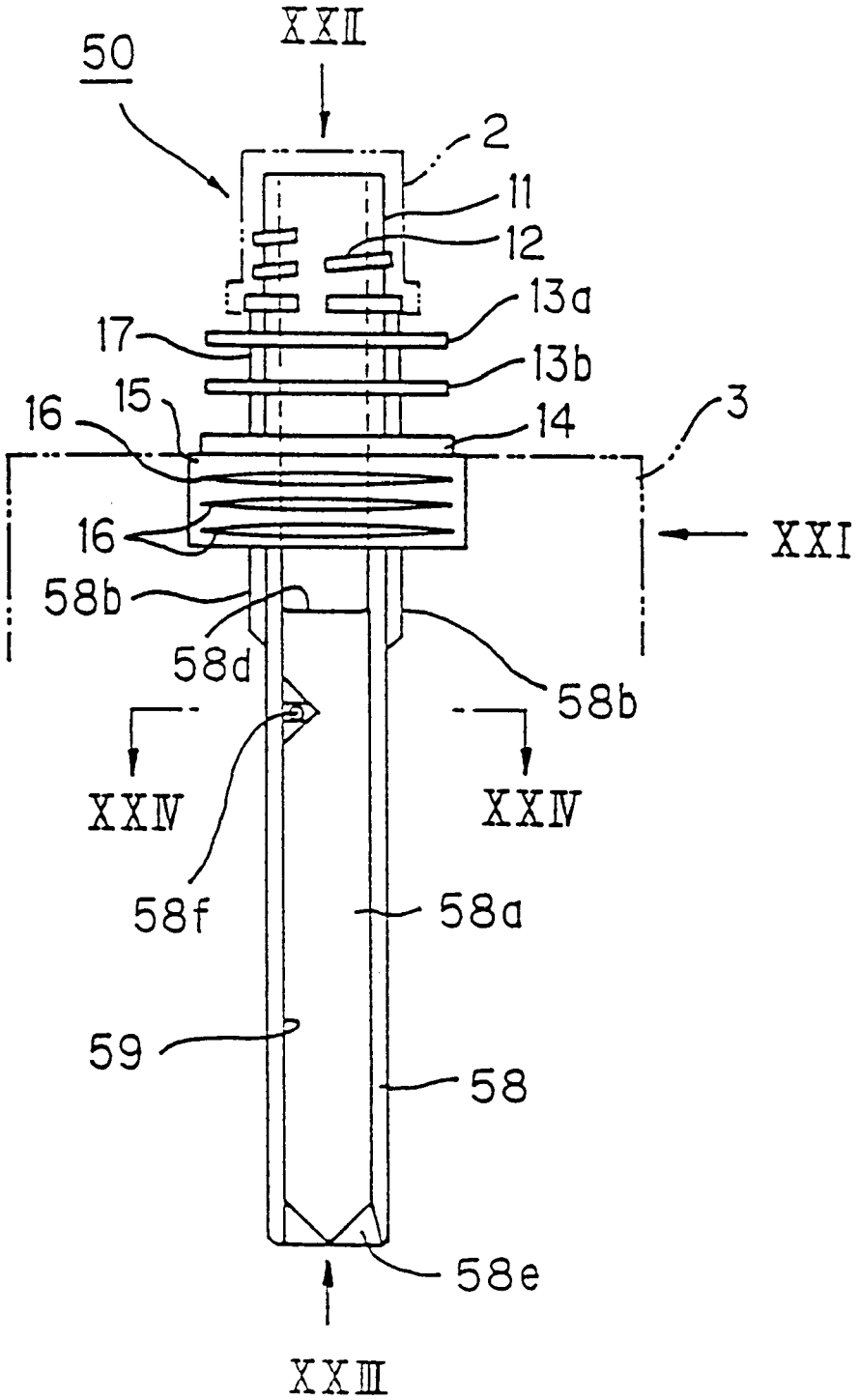
FIG. 20 is a front view illustrating the fifth embodiment of the plug according to this invention.

In the plug 50 of the present embodiment, therefore, the split pipe 58 can be easily drawn from the molding die used therefor because the inner wall of this split pipe 58 has a flat surface (FIG. 24 refers) along the direction of drawing from the molding die (the direction perpendicular to the surface of the paper bearing FIG. 20).

Between the leading terminal (lower terminal) and the basal terminal (upper terminal) of the split pipe 58, a joint plate 58*a* for joining the divided halves of the split pipe 58 in the direction of thickness of the container proper 3 is formed so as to give rise to a through hole 58*d* (FIGS. 20 and 21 refer) larger than the diameter of the split pipe 58*a* in the proximity of the upper terminal of the split pipe 58 as illustrated in FIGS. 20–24.

That is, the joint plate 58*a* in this embodiment equals the joint plate 48*a* in the fourth embodiment described above, excepting the through hole 58*d* of the size mentioned above is formed on the upper terminal side of the joint plate 48*a*.

The plug 50 in the present embodiment, therefore, retains the same degree of strength as that of the split pipe 23 in the fourth embodiment, yet allows the interior of the split pipe 58 to form a path continuing in the direction of diameter, and prevents the interior of the through hole 58*d* from being intruded by the leading terminal of other plug 50. When a multiplicity of such plugs 50 are randomly piled by an automatic aligning device, they can be smoothly handled without being caught on one another.

Figure 21:
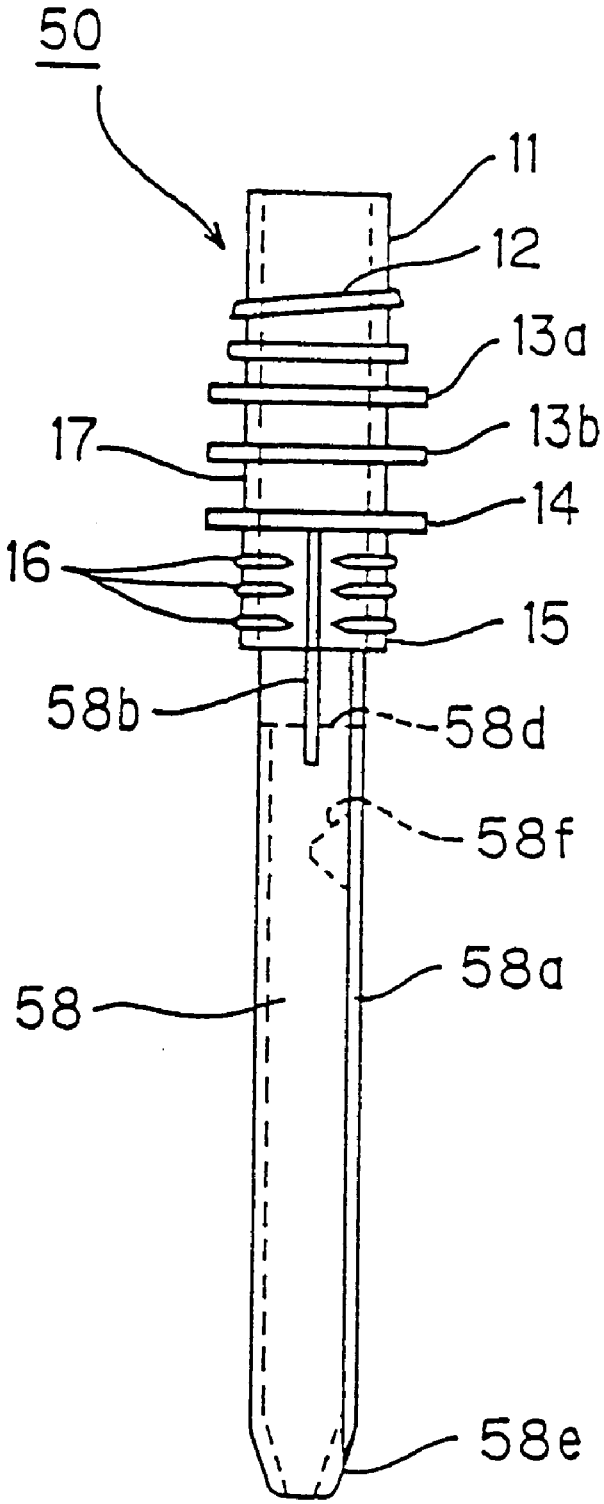
FIG. 21 is a side view of FIG. 20 taken from the direction of an arrow line XXI.
Figure 22:
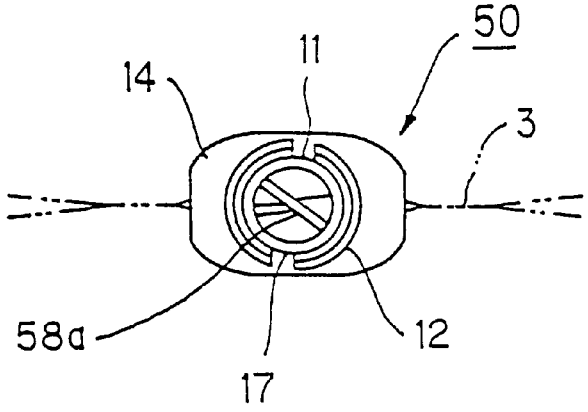
FIG. 22 is a plan view of FIG. 20 taken from the direction of an arrow line XXII.
Figure 23:
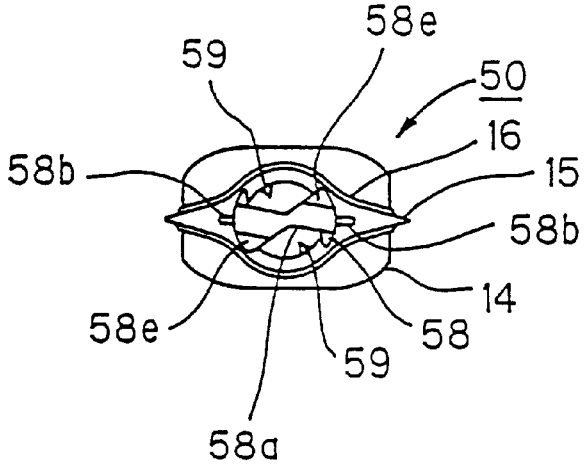
FIG. 23 is a bottom view of FIG. 20 taken from the direction of an arrow line XXIII.

Further, the leading terminal of the split pipe 58 forms a chamfered part 58*e* so as to round the corners as illustrated in FIGS. 20, 21, and 23.

That is, the present embodiment forms the chamfered part 58*e* in the plate of the bottom plate 38*c* in the third and fourth embodiments described above.

The plug 50 in the present embodiment, similarly to that in the third and fourth embodiments described above, can notably repress the possibility of inflicting damage on the container proper 1. Even when a multiplicity of such plugs 50 are randomly piled up by an automatic aligning device, therefore, they can be prevented from inflicting damage on one another.

Figure 24:
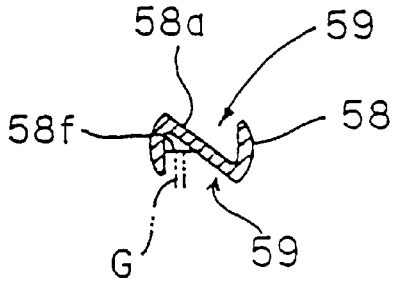
FIG. 24 is a cross section taken through FIG. 20 along the line XXI–XXIV.

On the central part in the longitudinal direction of the plug 50 and in the part joining the split pipe 58 and the joint plate 58*a*, a protuberance 58*f* intended as a gate G for introducing molten resin (a pin gate indicated by a two-dot chain line in FIG. 24) is formed as illustrated in FIGS. 20, 21, and 24. Since this gate G is located closely to the central position of the whole of the plug 50, it improves the run of the molten resin at the time of injection, precludes the trouble of short shots, and enhances the yield of the formed article. In this case, a device for cutting off the gate resin by constricting the neighborhood of the outlet of the gate enables a gate mark to remain on the inner side of the split pipe 58 and consequently obviates the necessity for such additional treatments as the removal of the residual resin protruding from the gate (the conventional split pipe has inevitably required the removal of the residual resin protruding from the gate because of the use of a submarine gate formed at the leading terminal of the split pipe parallelly to the split surface of the die).

The present embodiment, therefore, naturally acquires the same effects as the fourth embodiment described above and further fulfills the requirements enumerated above.

The present embodiment, as described above, uses the container proper 3 having the gusset 3*a* formed solely on the bottom part, it may alternately use the container proper 1 having the gussets 1*a*, 1*b* formed on the bottom part and the opposite lateral sides.

SIXTH EMBODIMENT

The sixth embodiment of the plug according to this invention and the pouch utilizing the plug will be described below by reference to FIGS. 25–30. It is provided, however, that the parts like those of the first through fifth embodiments described above will be denoted by the reference numerals like those used in the description of the first through fifth embodiments and these parts will be omitted from the following description.

Figure 25:
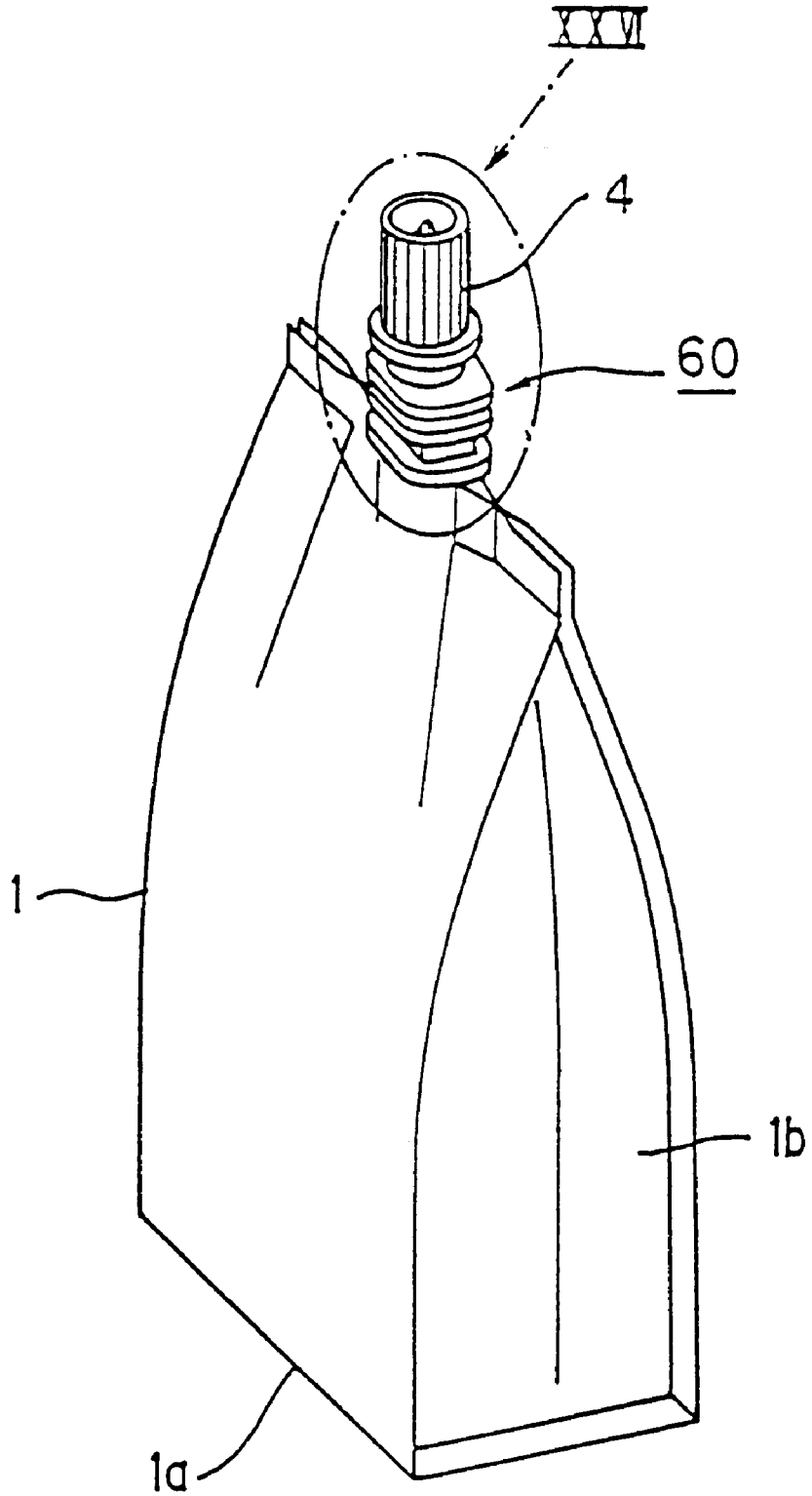
FIG. 25 is a perspective view illustrating the entire structure of the sixth embodiment of the container of indeterminate shape according to this invention.
Figure 26:
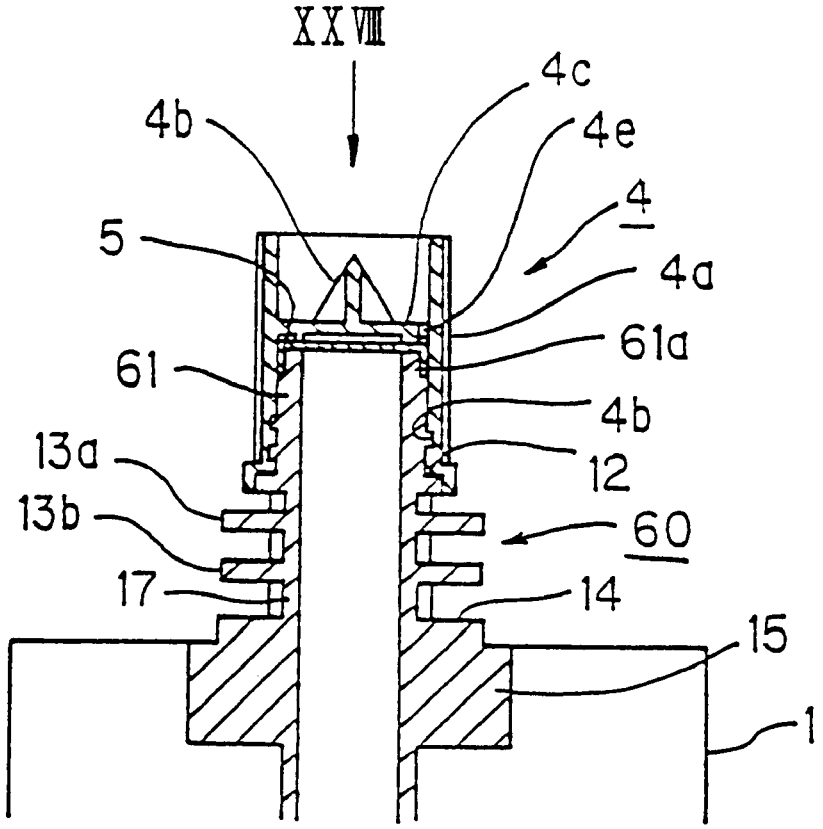
FIG. 26 is a partly extracted magnified cross section taken through FIG. 25 along an arrow line XXVI.
Figure 27:
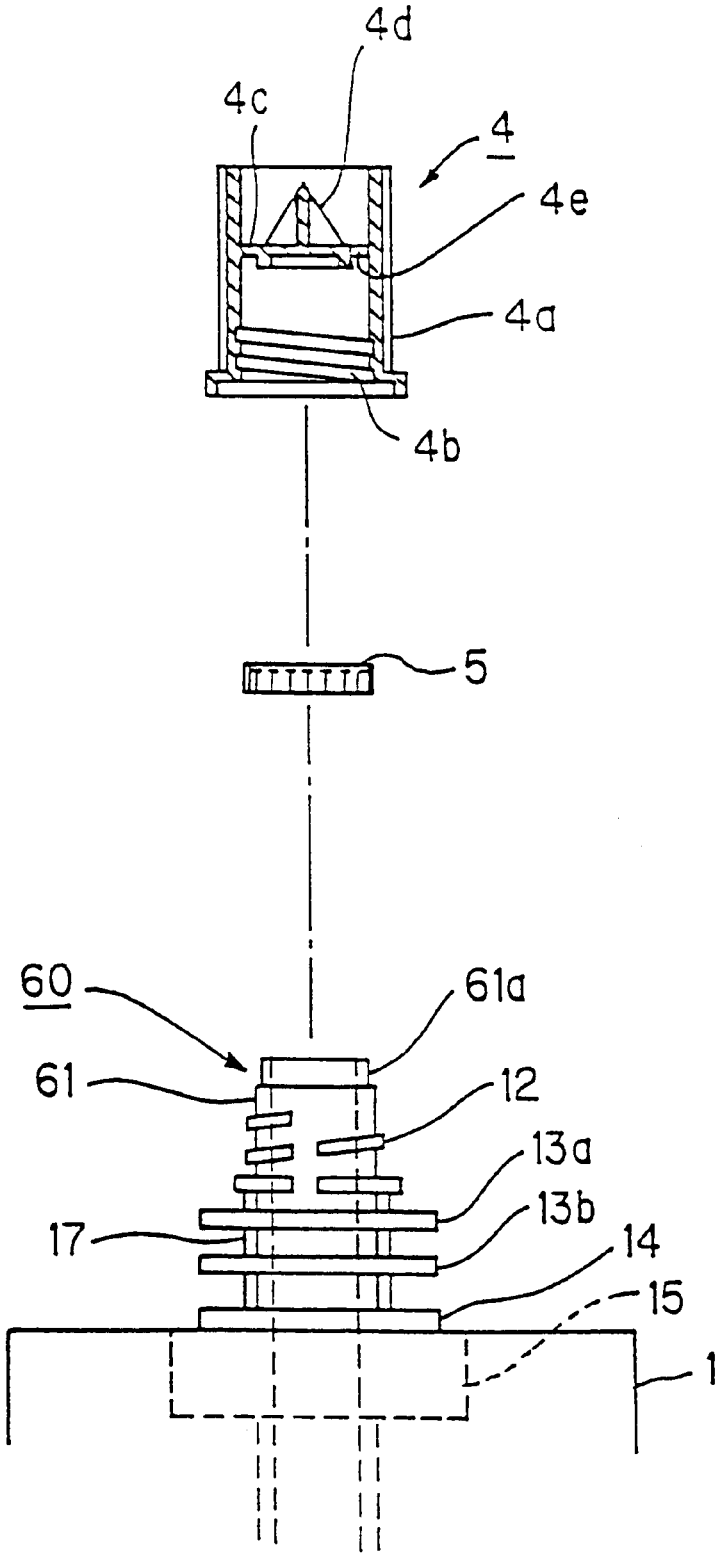
FIG. 27 is an exploded view of FIG. 26.
Figure 28:
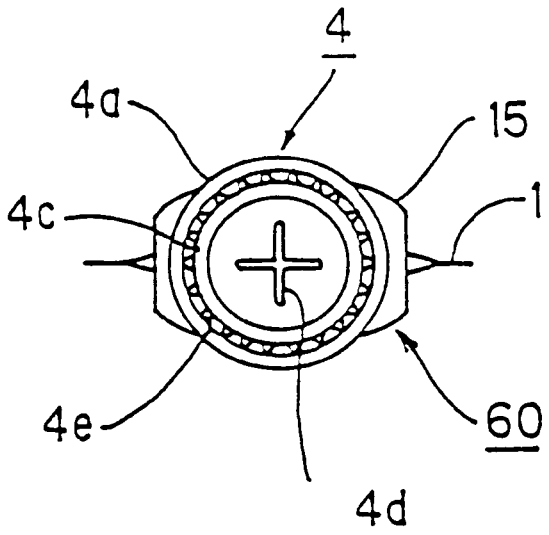
FIG. 28 is a plan view of FIG. 16 taken from the direction of an arrow line XXVIII.

At the leading terminal of a mouth part 61 of a plug 60, a small-diameter part 61*a* having a slightly smaller outside diameter is formed as illustrated in FIGS. 25–27.

Figure 29:
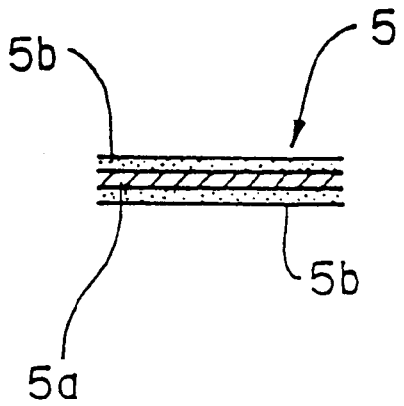
FIG. 29 is a cross section illustrating the structure of an inner lid.

To the leading terminal of the small-diameter part 61*a* of the mouth part 61, namely the other terminal of the plug 60, the inner lid 5 formed of film crowning the small-diameter part 61 in an occluding manner is watertightly fastened thermally. This inner lid 5 is formed of a thin three-layer construction produced by laminating an aluminum film 5*a* with two opposed polypropylene films 5*b* as illustrated in FIG. 29. It abounds in tensile strength and possesses a quality of readily yielding to thermal adhesion and easily sustaining breakage.

To the mouth part 61 of the plug 60, a cap 4 is fastened as meshed with the screw 12. This cap 4 is constructed as follows.

The cap 4, as illustrated in FIGS. 25–28, comprises a cylindrical main body 4*a*, a screw 4*b* formed on the one terminal side of the inner wall of the main body 4*a* and meshed with the aforementioned screw 12 of the plug 60, an inner plate 4*c* disposed in the central part of the interior of the main body 4*a* and adapted to partition the interior of the main body 4*a* into one terminal side and the other terminal side, a cruciform protuberance 4*d* raised from the inner plate 4*c* on the other terminal side of the main body 4*a*, and a plurality of small holes 4*e* formed along the periphery of the inner plate 4*c* so as to intercommunicate the one terminal side and the other terminal side of the interior of the main body 4*a*.

Figure 30A:
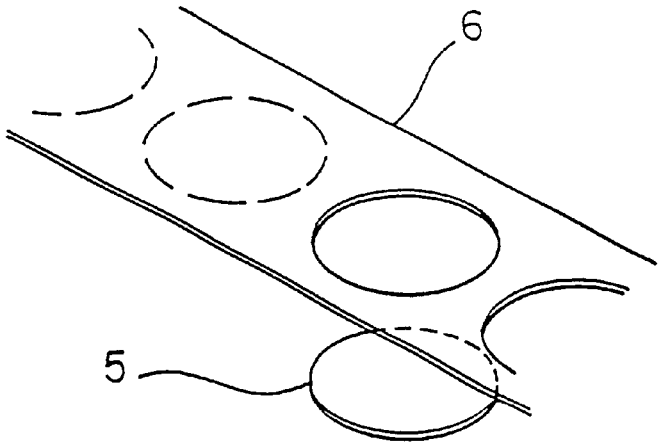
FIGS. 30(*a*)–30(*c*) are an explanatory diagram of the process of mounting the inner lid.
Figure 30B:
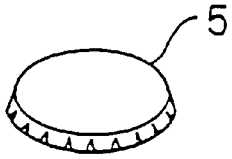
Figure 30C:
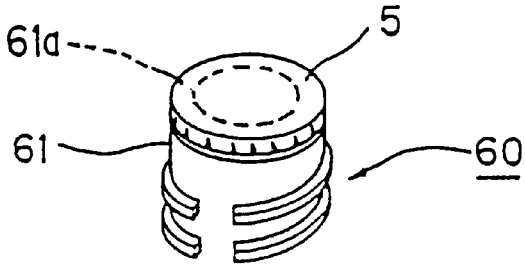

The pouches constructed as described above and filled with a given liquid can be plugged by a high speed plugging instrument with no sacrifice of productivity rate by a procedure which comprises successively punching circular inner lids 5 from the film 6 of the aforementioned three-layer structure being advanced in the form of a tape [FIG. 30(*a*) refers], draw forming the circular inner lids 5 in the shape of a crown [FIG. 30(*b*) refers], mounting the resultant crowns on the leading terminals of the aforementioned small-diameter parts 61*a* of the containers proper 1 already filled with the liquid, heat-sealing the crowns annularly along the peripheral edges of the small-diameter parts 61*a* [FIG. 30(*c*) refers] and then, by means of a device adapted to effect the attachment of the cap 4 to the plug 60, laid parallelly to a liquid filling line, and operated synchronously with the speed of liquid filling by the liquid filling line, continuously handling the inner lids 5 and the caps 4 and meanwhile attaching them to the plugs 60.

By attaching the inner lid 5 and the cap 4 to the plug 60 of the pouch having the interior of the container proper 1 thereof filled in advance with the liquid, the interior of the container proper 1 can be perfectly sealed. The liquid filling the container proper 1 in the pouch can be thermally sterilized by immersing the pouch in hot water.

Unlike the conventional pouch which has been applicable only to liquids of low acidity the pouch of this invention can be applied additionally to liquids of neutrality (such as, for example, tea, coffee, and similar beverages). The pouches containing such beverages, therefore, can be sold not merely during the summer season but also all year round.

The small holes 4*e* are formed in the inner plate 4*c* of the cap 4. Even when water collects on the inner plate 4*c* of the cap 4 as during such a process of sterilization as mentioned above, therefore, the treatment of the cap 4 subsequent to the process of the sterilization can be facilitated because the water is passed through the small holes 4*e* and discharged to the exterior of the cap along the screw 12 of the plug 60.

In the case of taking out the liquid which fills the interior of the pouch, by turning the cap 4 until it separates from the plug 60 and then depressing the other terminal side of the cap 4 in such a manner as to be inserted into the mouth part 61 of the plug 60, the liquid in the container proper 1 can be extracted through the plug 60 because the inner lid 5 can be easily broken through by the protuberance 4*d* of the cap 4.

The present embodiment, therefore, naturally acquires the same effects as the embodiments described above and further fulfills the requirements enumerated above.

The present embodiment, as described above, uses the container proper 1 having the gussets 1*a*, 1*b* formed on the bottom part and the opposite lateral sides, it may alternately use the container proper 3 having the gusset 3*a* formed solely on the bottom part.

The plug according to this invention is a cylindrical plug which is attached to a pouchy container capable of varying shape as passed through the container proper in such a manner that one terminal side thereof may be positioned inside the container proper and the other terminal side thereof positioned outside the container proper. This plug comprises a split pipe connected to one terminal side of the plug and divided into two halves along the longitudinal direction so as to be provided with interstices intercommunicating between the inside and the outside and a joint plate for integrally coupling one and the other half of the split pipe. It, therefore, secures a path for air or liquid during the aspiration of the liquid from the interior of the container proper. When the container proper happens to develop negative pressure, the plug prevents the path for the liquid from being blocked owing to the flexibility of the container proper, precludes the occurrence of a dead space for stagnating liquid in the upper part of the container proper, and enables the split pipe to retain the shape and the strength thereof. When this plug is utilized for the container of indeterminate shape, therefore, it can fulfill such conditions as permitting easy extraction of air from the interior of the pouch while the pouch is being filled with a liquid and enabling the liquid in the pouch to be easily extracted without leaving behind a residue of the liquid in the pouch.

What is claimed is:

1. A cylindrical plug attached to a pouch container, the pouch container capable of varying its shape, the cylindrical plug having one terminal side positioned inside the pouch container, the cylindrical plug having a second terminal side positioned outside said pouch container comprising:

a split pipe connected to the one terminal side and divided into two halves along its longitudinal direction, so that the split pipe is provided with interstices intercommunicating between the inside and the outside of the split pipe, and a joint plate for integrally coupling the two halves of the split pipe, the two halves of the split pipe joined by said joint plate, the joint plate having a S shape, with each side of the S shape having a continuous uninterrupted surface, so that the thickness of the S shape is constant along the total length of the S shape.

2. A plug according to claim 1, wherein said split pipe is provided on an outer surface thereof with a reinforcing rib.

3. A plug according to claim 1, wherein said split pipe is provided at a leading terminal thereof with a bottom plate.

4. A plug according to claim 3, wherein said split pipe is provided on an outer surface thereof with a reinforcing rib.

5. A plug according to claim 1, wherein said split pipe has a chamfered part formed on a leading terminal.

6. A plug according to claims 5, wherein said split pipe is provided on an outer surface thereof with a reinforcing rib.

7. A plug according to claim 1, wherein said joint plate is formed throughout the entire length of said split pipe.

8. A plug according to claim 7, wherein said split pipe is provided on an outer surface thereof with a reinforcing rib.

9. The device according to claim 1, wherein the joint plate extends a total length of the split pipe.

10. A cylindrical plug attached to a pouch container, the pouch container capable of varying its shape, the cylindrical plug having one terminal side positioned inside the pouch container, the cylindrical plug having a second terminal side positioned outside said pouch container comprising:

a split pipe connected to the one terminal side and divided into two halves along its longitudinal direction, so that the split pipe is provided with interstices intercommunicating between the inside and the outside of the split pipe, and a joint plate for integrally coupling the two halves of the split pipe, the two halves of the split pipe joined by said joint plate, the joint plate having a Z shape, with each side of the Z shape having a continuous uninterrupted surface, so that the thickness of the Z shape is constant along the total length of the Z shape.

11. A plug according to claim 10, wherein said split pipe is provided on an outer surface thereof with a reinforcing rib.

12. The device according to claim 10, wherein the joint plate extends a total length of the split pipe.

13. A cylindrical plug attached to a pouch container, the pouch container capable of varying its shape, the cylindrical plug having one terminal side positioned inside the pouch container, the cylindrical plug having a second terminal side positioned outside said pouch container comprising:

a split pipe connected to the one terminal side and divided into two halves along its longitudinal direction, so that the split pipe is provided with interstices intercommunicating between the inside and the outside of the split pipe, and a joint plate for integrally coupling the two halves of the split pipe, wherein said joint plate is disposed over interval between a leading terminal and the vicinity of a basal terminal of said split pipe so as to form on the basal terminal side of said split pipe a through hole of a size smaller than the diameter on the leading terminal side of said split pipe.

14. A cylindrical plug attached to a pouch container, the pouch container capable of varying its shape, the cylindrical plug having one terminal side positioned inside the pouch container, the cylindrical plug having a second terminal side positioned outside said pouch container comprising:

a split pipe connected to the one terminal side and divided into two halves along its longitudinal direction, so that the split pipe is provided with interstices intercommunicating between the inside and the outside of the split pipe, and a joint plate for integrally coupling the two halves of the split pipe, wherein a protuberance intended as a gate for introducing molten resin during the course of molding is disposed in a connecting part intervening between said split pipe and said joint plate.

15. A pouch container of indeterminate shape, comprising:

a cylindrical plug attached to the pouch container, the cylindrical plug having one terminal side positioned inside the pouch container, the cylindrical plug having a second terminal side positioned outside said pouch container, a split pipe connected to the one terminal side and divided into two halves along its longitudinal direction, so that the split pipe is provided with interstices intercommunicating between the inside and the outside of the split pipe, a joint plate for integrally coupling the two halves of the split pipe, wherein said joint plate is disposed over an interval between a leading terminal and the vicinity of a basal terminal of said split pipe so as to form on the basal terminal side of said split pipe a through hole of a size smaller than the diameter on the leading terminal side of said split pipe.

16. A pouch container of indeterminate shape according to claim 15, wherein an inner lid of the pouch container formed of film is thermally fastened watertightly to the second terminal side of said plug.

17. The pouch container of indeterminate shape according to claim 16, further including a cap having a cylindrical main body having one terminal side thereof removably screwed to the second terminal side, an inner plate disposed in a central part of the interior of said main body and effective to partition the interior of said main body into one terminal side and the another terminal side, and a protuberance raised from said inner plate on the second terminal side of said main body.

* * * * *